US006589411B1

(12) United States Patent
Kimpel et al.

(10) Patent No.: US 6,589,411 B1
(45) Date of Patent: Jul. 8, 2003

(54) ELECTRODEPOSITION COATING PROCESS

(75) Inventors: Matthias Kimpel, Schwelm (DE); Martin Wulf, Wuppertal (DE); Oliver Reis, Witten (DE); Gerhard Pech, Vienna (AT); Christoph Moelzer, Traiskirchen (AT)

(73) Assignee: E.I. du Pont de Nemours and Company, Wilmington, DE (US)

( * ) Notice: Subject to any disclaimer, the term of this patent is extended or adjusted under 35 U.S.C. 154(b) by 51 days.

(21) Appl. No.: 09/852,382

(22) Filed: May 10, 2001

(51) Int. Cl.[7] ..... C25D 13/00

(52) U.S. Cl. ..... 204/478; 204/493; 204/507; 204/509

(58) Field of Search ..... 204/478, 509, 204/507, 493

(56) References Cited

U.S. PATENT DOCUMENTS 6,113,764 A * 9/2000 Emch ..... 204/509

* cited by examiner

*Primary Examiner*—K. Mayekar
(74) *Attorney, Agent, or Firm*—Sudhir G. Deshmukh

(57) ABSTRACT

An electrodeposition coating process consisting of the successive process steps:

1) electrodeposition of a coating layer of an electrodeposition coating agent that contains a thermally curable binder system onto the surface of an electrically conductive substrate and
2) thermal curing of the electrodeposited coating layer by irradiation with near infrared radiation.

11 Claims, No Drawings

ELECTRODEPOSITION COATING PROCESS

FIELD OF THE INVENTION

The invention relates to a process for coating electrically conductive substrates with aqueous electrodeposition coating agents.

BACKGROUND OF THE INVENTION

Electrodeposition coating agents are in particular used for the production of corrosion protective primers on metallic substrates. After electrodeposition, the electrodeposition coating layers are usually baked.

Electrodeposition primers should exhibit good mechanical properties, especially on external surfaces facing towards an observer, as these surfaces are exposed to external mechanical influences. Electrodeposition primers are intended to protect not only the surfaces, but also the edges of substrates from corrosion. Edge corrosion on edges visible to the observer is particularly aesthetically troublesome, for example, taking the form of visible rust spots and streaks that develop on the coated substrates during use.

There is a requirement for an electrodeposition coating process that produces electrodeposition coated substrates which, in addition to good surface corrosion protection, a) exhibit good edge corrosion protection and/or b) the electrodeposition coating of which has improved resistance to mechanical stresses.

It has now been found that electrodeposition coating layers exhibit surprisingly improved mechanical properties if they have been cured by irradiation with near infrared radiation (NIR radiation) instead of by conventional baking. Surprisingly, improved edge corrosion protection may also be achieved with an electrodeposition coating cured in this manner. Both effects may simultaneously be achieved on substrates comprising edges if the electrodeposition coating layer on the surfaces and on the edges of the substrates are cured by means of NIR-irradiation.

The term "curing" used in the description and in the patent claims means curing in the sense of chemical cross-linking of the electrodeposition coating layer by the formation of covalent bonds between the constituents of the thermally curable electrodeposition coating binder system.

SUMMARY OF THE INVENTION

One general embodiment of the present invention is an electrodeposition coating process consisting of the successive process steps:

1) electrodeposition of a coating layer of an electrodeposition coating agent that contains a thermally curable binder system onto the surface of an electrically conductive substrate and
2) thermal curing of the electrodeposited coating layer by irradiation with near infrared radiation.

DETAILED DESCRIPTION OF THE EMBODIMENTS

In the case of substrates having zones both accessible and inaccessible to near infrared radiation, after electrodeposition coating and completion of the NIR-irradiation, a thermal curing step is performed by conventional methods of heat input in order to cure completely uncured or incompletely cured portions of the electrodeposition coating layer. In the case of such substrates, another embodiment of the present invention consists in an electrodeposition coating process consisting of the successive process steps:

1) electrodeposition of a coating layer of an electrodeposition coating agent that contains a thermally curable binder system onto the surface of an electrically conductive substrate comprising zones accessible and inaccessible to near infrared irradiation,
2) thermal curing by near infrared irradiation of the zones of the electrodeposited coating layer accessible to irradiation with near infrared radiation and
3) thermal curing of hitherto uncured portions of the electrodeposition coating layer by means of heat input without NIR-irradiation.

In the event that the substrates comprise edges and it is only desired to achieve improved edge corrosion protection, it is also possible to proceed in such a manner that, after electrodeposition coating, the electrodeposition coating layer is cured by NIR-irradiation only on edges or in the zone of edges, including relevant edges, before a thermal curing step subsequently proceeds by means of conventional heat input methods. The edges may comprise all the edges or only selected edges or parts of edges. This further embodiment of the invention comprises an electrodeposition coating process consisting of the successive process steps:

1) electrodeposition of a coating layer of an electrodeposition coating agent that contains a thermally curable binder system onto the surface of an electrically conductive substrate comprising edges,
2) thermal curing of the electrodeposited coating layer on edges or in the zone of edges, including relevant edges, by near infrared irradiation and
3) thermal curing of hitherto uncured portions of the electrodeposition coating layer by means of heat input without NIR-irradiation.

Another embodiment of the invention is an electrodeposition coating process consisting of the successive process steps:

1) electrodeposition of a coating layer of an electrodeposition coating agent that contains a thermally curable binder system onto the surface of an electrically conductive substrate comprising edges with zones accessible and inaccessible to near infrared irradiation,
2) thermal curing by near infrared irradiation of the electrodeposited coating layer on edges or in the zone of edges, including relevant edges, and of zones of the electrodeposited coating layer accessible to irradiation with near infrared radiation and
3) thermal curing of hitherto uncured portions of the electrodeposition coating layer by means of heat input without NIR-irradiation.

Per se known electrodeposition coating agents are used in the process according to the invention. These are aqueous coating agents with a solids content of, for example, 10 to 30 wt. %. The solids content consists of the resin solids, optionally, together with fillers, pigments and conventional non-volatile paint additives. The resin solids content comprises the sum of the solid constituents of the thermally curable binder system. The binder systems contained in the electrodeposition coating agents comprise binder systems conventional in electrodeposition coatings that are thermally curable by free-radical polymerization of olefinically unsaturated double bonds and/or by condensation reactions and/or addition reactions. Binder systems curable by condensation reactions and/or addition reactions are preferred. The binder systems may contain self-cross-linking binders or combinations of externally cross-linking binders and cross-linking agents. Nonionic additive resins and paste resins serving to disperse pigments may optionally also be present, as may microgels. For example, the composition of the electrodeposition coating binder system comprises solids contents proportions by weight adding up to 100 wt. % of 50 to 100 wt. % of electrodeposition coating binders, 0 to 50 wt. % of cross-linking agents, 0 to 30 wt. % of nonionic additive resins and 0 to 20 wt. % of paste resin. The sum of the solids content by weight of cross-linking agent, nonionic additive resin and paste resin is at most 50 wt. % of the resin solids content of the electrodeposition coating binder system.

The electrodeposition coating agents may for example comprise conventional anodically electrodepositable (AED) coating agents. AED coating agents contain, for example, binders based on polyesters, epoxy resin esters, (meth) acrylic copolymer resins, maleinate oils or polybutadiene oils with a weight-average molecular mass (Mw) of, for example, 300 to 10,000 and an acid value from 35 to 300 mg KOH/g. The binders carry —COOH, —$SO_3H$ and/or —$PO_3H_2$—groups and, after neutralization of at least a part of the acid groups with bases, particularly amines, may be converted into the aqueous phase. The binders may be self-cross-linking or externally cross-linking. The AED coating agents may therefore also contain conventional cross-linking agents, e.g., triazine resins, cross-linking agents containing groups capable of transesterification or blocked polyisocyanates.

Conventional cathodically electrodepositable (CED) coating agents based on CED binders may also be used as electrodeposition coating agents in the process according to the invention. The CED binders contain one or more cationic or basic groups, for example, primary, secondary and/or tertiary amino and/or ammonium, e.g., quaternary ammonium, phosphonium and/or sulfonium groups. The CED binders have, for example, amine values from 20 to 250 mg KOH/g and weight-average molecular masses (Mw) of preferably 300 to 10,000. Neutralizing agents used for the CED binders are the conventional acids for CED coating agents, such as, formic acid, acetic acid, lactic acid, methanesulfonic acid. Examples of CED binders include aminoepoxy resins, aminoepoxy resins with terminal double bonds, aminoepoxy resins with primary OH groups, aminopolyurethane resins, amino group-containing polybutadiene resins or modified epoxy resin/carbon dioxide/amine reaction products, and amino(meth)acrylate resins. The CED binders may be self-cross-linking or they may be used in mixture with well known cross-linking agents. Examples of such cross-linking agents include aminoplastic resins, blocked polyisocyanates, cross-linking agents with terminal double bonds, polyepoxy compounds or cross-linking agents containing groups capable of transesterification.

The electrodeposition coating agents may contain color-imparting and/or special effect-imparting pigments and/or fillers in a ratio by weight of pigment plus filler to resin solids content of for example 0:1 to 0.8:1. Examples of pigments and fillers include conventional inorganic and/or organic colored pigments and/or special-effect pigments, such as, titanium dioxide, iron oxide pigments, carbon black, phthalocyanine pigments, quinacridone pigments, metallic pigments, e.g. of aluminium, interference pigments, such as, titanium dioxide-coated aluminium, coated mica, iron oxide in flake form, copper phthalocyanine pigments in flake form, kaolin, talc or silica.

The electrodeposition coating agents may contain additives, for example, in quantity proportions from 0.1 to 5 wt. %, based on the resin solids. Examples of additives are organic solvents, wetting agents, neutralizing agents, levelling agents, catalysts, corrosion inhibitors, antifoaming agents, light stabilisers, antioxidants, colorants, biocides and conventional anticratering additives.

Since the layer of the electrodeposition coating that is deposited on a substrate must be able to absorb NIR radiation to be cured, some of the constituents of the electrodeposition coating may be selected that are especially adapted to absorb NIR radiation.

The substrates that are electrodeposition-coated in the process according to the invention are electrically conductive substrates. Examples are electrically conductive polymer substrates, substrates constructed on a composite basis from electrically conductive polymer substrates and metals, and in particular metal substrates. The substrates may comprise flat substrates in which both surfaces and edges are completely visible to the observer or completely accessible to irradiation with NIR radiation. They may, however, also comprise three-dimensional substrates that may comprise zones (edges and/or surface zones) both accessible and inaccessible to NIR radiation (visible and non-visible to the observer). "Accessible" or "visible" here means in particular immediately accessible or immediately visible, i.e. accessible from the outside without particular technical or optical aids. Examples of substrates with zones accessible and inaccessible to irradiation with NIR radiation are truck chassis, agricultural machines, household appliance housings as well as small bulk goods with visible and optionally, non-visible surface zones and in particular, automotive bodies which comprise cavities, recesses and other structurally-determined undercuts, and automotive body parts. Examples of visible surfaces of an automotive body include, in particular, its immediately visible outer skin and also visible interior surfaces, for example, surfaces that are visible when the doors are opened, such as, sills. Non-visible or not immediately visible surface zones include interior surfaces, for example, of hollow areas, and also other surfaces that are not directly accessible. Examples of non-visible or not immediately visible surfaces of an automotive body include surfaces in the interior of an automotive body, for example, motor space, passenger space or trunk, interior surfaces of hollow areas. Examples of automotive body edges directly accessible to the observer are externally visible cut edges of individual automotive body parts, hole edges, for example of clip holes or edges of openings provided for components to be installed, such as, windows, headlights, door locks or door handles, and gutter edges.

The electrodeposition coating layer is applied onto the entire surface of the substrates in usual manner from the electrodeposition coating agent, for example, to a dry film thickness of 5 to 40 $\mu$m and adhering electrodeposition coating bath material is removed in usual manner. The electrodeposition coating layer is then thermally cured, specifically, depending upon the embodiment of the process according to the invention, exclusively by NIR-irradiation or by NIR-irradiating at least a proportion of the zones accessible to irradiation with NIR radiation of the whole electrodeposition coating layer. In the latter case, after NIR-irradiation, additionally thermal curing of the zones of the electrodeposition coating layer that are not NIR-irradiated is performed by conventional means of heat input without the use of NIR-irradiation. The embodiment of the process according to the invention is here selected as a function of the nature of the substrate and the intended technical objective. For example, once automotive bodies have been electrodeposition coated, that portion of the electrodeposition coating layer located on the outer skin of the body, including externally accessible edges is thermally cured by NIR-irradiation, followed by baking in order to cure any uncured or incompletely cured portions of the electrodeposition coating layer located on other zones of the body surface.

The NIR radiation used in the process according to the invention must not be confused with longer-wave IR radiation; rather, it is short-wave infrared radiation in the wavelength range from about 750 nm to about 1500 nm, preferably 750 nm to 1200 nm. Radiation sources for NIR radiation include, for example, conventional NIR radiation emitters that may emit radiation as a flat, linear or point source. NIR radiation emitters of this kind are commercially available (for example, from Adphos). They are, for example, high-performance halogen radiation emitters with an intensity (radiation output per unit area) of generally more than 10 $kW/m^2$ to, for example, 10 $MW/m^2$, preferably from 100 $kW/m^2$ to 800 $kW/m^2$. The radiation emitters reach, for example, an radiation emitter surface temperature (coil filament temperature) of more than 2000° K, preferably of more than 2800° K, particularly more than 2900° K, e.g., a temperature from 2000 to 3500° K. Suitable radiation emitters have, for example, an emission spectrum with a maximum between 750 and 1200 nm.

NIR-irradiation may be carried out, for example, in a belt unit fitted with one or more NIR radiation emitters or with one or more NIR radiation emitters positioned in front of the three-dimensional object to be irradiated, or the object to be irradiated and/or the NIR radiation emitter(s) is(are) moved relative to one another during irradiation. For example, the object to be irradiated may be moved through an irradiation tunnel fitted with one or more NIR radiation emitters, and/or a robot fitted with one or more NIR radiation emitters may guide the NIR radiation emitter(s) over the surface to be irradiated, for example, in the manner of a silhouette-like guiding of the NIR radiation emitters.

The arrangement of the NIR radiation emitters may be adapted to the specific nature of the substrate, for example, an automotive body, or substrate edges to be irradiated. Accordingly, it is possible to NIR-irradiate only edges or zones of the substrate comprising edges.

In principle, the irradiation time, distance from the object, radiation output and/or radiation emitter surface temperature of the NIR radiation emitter may be varied during NIR-irradiation. The distance between the object and NIR radiation emitter may be, for example, 2 to 60 cm. NIR irradiation may take place continuously or discontinuously (in cycles). The irradiation time may be, for example, 1 to 100 seconds, preferably not more than 60 seconds. The irradiation time refers either to the duration of continuous irradiation or to the sum of the periods of different irradiation cycles. By selecting the various parameters in a controlled manner, different surface temperatures of the electrodeposition coating layer may be obtained, for example, surface temperatures from 100° to 300° C.

The various irradiation parameters, such as belt speed or irradiation time, distance from object, radiation output of the NIR radiation emitter used, may be adapted by the skilled person according to the requirements of the coating task in question.

While in the general embodiment of the process according to the invention, the entire electrodeposition coating layer is cured by NIR-irradiation, in the other three embodiments described above, hitherto uncured portions of the electrodeposition coating layer that covers the entire substrate surface are subsequently thermally cured by means of heat input methods without NIR-irradiation. The hitherto uncured portions of the electrodeposition coating layer comprise in particular portions of the electrodeposition coating layer not NIR-irradiated deliberately or due to circumstances, for example, due to the substrate geometry and/or design of the NIR irradiation system used.

In the three further embodiments of the process according to the invention, once NIR-irradiation is complete, curing of the electrodeposition primer on the substrate does not encompass the entire electrodeposition-coated surface. Rather, depending upon the embodiment, an electrodeposition-coated substrate is obtained, the electrodeposition coating layer of which is cured on all, selected or parts of edges and/or sub-zones of the object surface, while a remaining portion of the entire electrodeposition coating layer is not cured or is incompletely cured. Depending upon object geometry and the circumstances during NIR-irradiation, the uncured or incompletely cured portion may be of greater or lesser size, for example in the case of automotive bodies may constitute 10 to under 100 area percent of the entire area of the electrodeposition coating layer.

Thermal curing of such hitherto uncured portions of the electrodeposition coating layer which occurs after completion of NIR-irradiation proceeds by means of conventional methods of heat input, i.e. without NIR-irradiation. Examples of conventional methods for heat input are in particular baking with convection and/or IR irradiation, for example at object temperatures from 130 to 180° C.

Once the electrodeposition coating layer has been cured, at least one further coating layer may be applied. In the case of substrates with visible and non-visible or not immediately visible surface zones, the at least one further coating layer is preferably applied only or substantially only onto the surface zones visible to the observer. For example, the coating layer applied from the electrodeposition coating agent may act as the coating layer that determines color shade and be overcoated with a clear coating layer or it may be overcoated with a top coat layer or a base coat/clear coat two-layer coating or a primer surfacer layer and a top coat layer or a primer surfacer layer and a base coat/clear coat two-layer coating.

The process according to the invention is in particular suitable in the automotive sector for the application of electrodeposition primers onto automotive bodies or automotive bodywork parts. Apart from good surface corrosion protection, the electrodeposition primer coatings provide, depending upon the embodiment of the process according to the invention selected for the production thereof, improved edge corrosion protection and/or elevated resistance to mechanical stresses.

The following examples show the advantages with respect to edge corrosion protection and mechanical strength of CED coatings cured by NIR irradiation compared to CED coatings cured by baking.

EXAMPLES

Example 1

From a CED coating bath (Herberts AQUA EC 5000, R 39606 by DuPont Performance Coatings GmbH & Co. KG, Wuppertal) CED coating layers were cathodically deposited in a dry film thickness of 20 $\mu m$ onto perforated (diameter of the perforations 10 mm), degreased, non-phosphated automotive body panels and rinsed with de-ionized water. After a flash-off time of 30 min. at room temperature the test panels were irradiated for 10 seconds from one side (front side) by means of an NIR radiation emitter (High-Burn radiation emitter by the company Adphos, 400 $kW/m^2$, output 100%). The distance between radiation emitter and surface of the CED coating layer was 10 cm.

The cathodic electrodeposition coating layer was cured on both sides of the steel panels.

Example 2

Example 1 was repeated except the CED coated steel panels were baked for 25 min at 175° C. (object temperature) instead of being exposed to NIR irradiation.

The test panels provided with the cured CED coating layers from Examples 1 and 2 were subjected to a salt spraying test for 240 hours according to DIN 50 021-SS. The edges of the perforations were rated according to rusting on edges (rating 0 to 5; 0, edges without rust; 1, occasional rust spots on edges; 2, rust spots on less than ⅓ of the edges; 3, ⅓ to 2 of the edges are covered with rust; 4, more than of the edges are covered with rust; 5, edges completely rusty). The panels from Example 1 were given a rating of 2 (rating on the front side irradiated by NIR radiation), the panels from Example 2 were given a rating of 4–5.

Example 3

Example 1 was repeated with the difference that phosphated and non-perforated test panels having one side pasted with a foil were used instead of non-phosphated, perforated and non-pasted test panels, and that the pasting foil was removed from the back side prior to the NIR irradiation.

Example 4

Example 2 was repeated with the difference that phosphated and non-perforated test panels having one side pasted with a foil were used instead of non-phosphated, perforated and non-pasted test panels and that the pasting foil was removed from the back side prior to baking.

The test panels provided with a cured CED coating layer from Examples 3 and 4 were subjected to a reverse-impact-test at room temperature (see ASTM D 2794, use of an indenter with a ⅝" -hemispherical head, bulging of the uncoated back side).

The rating of the CED coating layer on the bulged front side resulted in a value of 150 inch-pound for the test panels from Example 3 and a value of 90 inch-pound for the test panels of Example 4.

What is claimed is:

1. An electrodeposition coating process consisting of the successive process steps:

1) electrodeposition of a coating layer of an electrodeposition coating agent which contains a thermally curable binder system onto the surface of an electrically conductive substrate and 2) thermal curing of the electrodeposited coating layer by irradiation with near infrared radiation, wherein said curing with near infrared radiation takes from 1 to 100 seconds.

2. The process of claim 1, wherein the substrate comprises zones accessible and inaccessible to near infrared irradiation, in process step 2) zones accessible to near infrared irradiation are irradiated with near infrared radiation and in an additional subsequent process step 3) thermal curing of hitherto uncured portions of the electrodeposition coating layer proceeds by means of heating without the use of near infrared irradiation.

3. The process of claim 2 , wherein heating proceeds in process step 3) by baking at an elevated temperature.

4. The process of claim 1, wherein the substrate comprises edges, in process step 2) the electrodeposited coating layer is irradiated with near infrared radiation on edges or in the zone of edges, including relevant edges, and in an additional, subsequent process step 3) thermal curing of hitherto uncured portions of the electrodeposition coating layer proceeds by means of heating without the use of near infrared irradiation.

5. The process of claim 4, wherein the substrate comprises zones accessible and inaccessible to near infrared irradiation and in process step 2), in addition to edges or in the zone of edges, further zones accessible to near infrared irradiation are irradiated with near infrared radiation.

6. The process of claim 4, wherein heating proceeds in process step 3) by baking at an elevated temperature.

7. The process of claim 1, wherein the electrodeposition coating agent is selected from the group consisting of anodically electrodepositable coating agents and cathodically electrodepositable coating agents.

8. The process of claim 1, wherein the substrates are selected from the group consisting of automotive bodies, automotive body-parts, truck chassis, agricultural machines, household appliance housings and small bulk goods.

9. The process of claim 1, wherein the NIR radiation is infrared radiation in the wavelength range from 750 nm to 1500 nm.

10. The process of claim 1, wherein the near infrared radiation is provided by near infrared radiation emitters with an intensity from 100 $kW/m^2$ to 10 $MW/m^2$.

11. The process of claim 1, wherein, after the electrodeposition coating layer has been cured, at least one additional coating layer is applied.

* * * * *

UNITED STATES PATENT AND TRADEMARK OFFICE

CERTIFICATE OF CORRECTION

PATENT NO. : 6,589,411 B1
DATED : July 8, 2003
INVENTOR(S) : Matthias Kimpel et al.

It is certified that error appears in the above-identified patent and that said Letters Patent is hereby corrected as shown below:

Column 7,
Line 15, the phrase "4, more than of" should read -- 4, more than ½ of --.

Signed and Sealed this

Sixth Day of January, 2004

JAMES E. ROGAN
*Director of the United States Patent and Trademark Office*